US007083072B2

(12) United States Patent
Redlin

(10) Patent No.: US 7,083,072 B2
(45) Date of Patent: Aug. 1, 2006

(54) INFLATABLE BODY FOR PRESSING ITEMS OF CLOTHING, AND APPARATUS FOR PRESSING ITEMS OF CLOTHING WITH THE INFLATABLE BODY

(75) Inventor: Kathrin Redlin, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 86 days.

(21) Appl. No.: 10/849,678

(22) Filed: May 20, 2004

(65) Prior Publication Data

US 2004/0245296 A1 Dec. 9, 2004

Related U.S. Application Data

(63) Continuation of application No. PCT/EP02/12586, filed on Nov. 11, 2002.

(30) Foreign Application Priority Data

Nov. 20, 2001 (DE) ..... 101 56 857

(51) Int. Cl.
*A41H 5/02* (2006.01)

(52) U.S. Cl. ..... 223/67

(58) Field of Classification Search ..... 223/66–71
See application file for complete search history.

(56) References Cited

U.S. PATENT DOCUMENTS

| | | | | |
|---|---|---|---|---|
| 2,985,344 | A * | 5/1961 | Quaintance | 223/67 |
| 3,268,126 | A | 8/1966 | Killey | |
| 3,326,427 | A * | 6/1967 | Schlemon | 223/67 |
| 3,568,900 | A | 3/1971 | Paris | |
| 4,303,183 | A * | 12/1981 | Schlemon | 223/67 |
| 4,475,673 | A * | 10/1984 | Ochiai | 223/70 |
| 5,361,516 | A * | 11/1994 | Dahman | 34/440 |
| 5,555,648 | A * | 9/1996 | Griffin | 34/621 |
| 5,566,867 | A * | 10/1996 | Goray | 223/66 |

FOREIGN PATENT DOCUMENTS

| | | |
|---|---|---|
| WO | 99/49123 | 9/1999 |

* cited by examiner

*Primary Examiner*—Gary L. Welch
(74) *Attorney, Agent, or Firm*—John T. Winburn; Russell W. Warnock; Craig J. Loest

(57) ABSTRACT

Items of clothing are smoothed by pulling them taut from within by way of an inflatable body that is detachably linked with a base that has a fan for inflating the inflatable body. In order to releasably fasten the inflatable body, the base has second fastening devices that are detachably linked with the first fastening devices of the inflatable body. In order to render it easier for an operator to fasten the inflatable body on the base and to reduce the risk of insufficiently fastening it, the inflatable body is provided with a rigid shaped element that is disposed next to the first fastening device.

20 Claims, 2 Drawing Sheets

INFLATABLE BODY FOR PRESSING ITEMS OF CLOTHING, AND APPARATUS FOR PRESSING ITEMS OF CLOTHING WITH THE INFLATABLE BODY

CROSS-REFERENCE TO RELATED APPLICATION

This application is a continuation, under 35 U.S.C. § 120, of copending international application No. PCT/EP02/12586, filed Nov. 11, 2002, which designated the United States; this application also claims the priority, under 35 U.S.C. § 119, of German patent application No. 101 56 857.6, filed Nov. 20, 2001; the prior applications are herewith incorporated by reference in their entirety.

BACKGROUND OF THE INVENTION

Field of the Invention

The invention relates to an inflatable body for pressing items of clothing and an apparatus with such an inflatable body. More specifically, the invention pertains to an inflatable body formed with an opening and, in the vicinity of the edge of the opening, first fastening devices for releasable connection to second fastening devices of a bottom part. The apparatus for pressing items of clothing with a non-rigid inflatable body has a bottom part with second fastening devices and an inflation system for inflating the inflatable body. The apparatus is constructed such that the first fastening devices and the second fastening devices are releasably connected to one another.

For the purpose of pressing items of clothing, it has become known for the latter to be tensioned from the inside using an inflatable body in order to remove creases in the item of clothing. For this purpose, the inflatable body is connected to a bottom part, which can generate a positive pressure in the inflatable body. It is necessary here for an opening of the inflatable body to be connected to an opening of the bottom part so as to fluidically communicate. The connection is advantageously air-tight. In order for it to be possible for the inflatable body to be exchanged or cleaned, the inflatable body, furthermore, is advantageously connected to the bottom part in a releasable manner.

An apparatus for pressing shirts which has a bottom part with an inflatable body fastened thereon is known in the art. The inflatable body consists of a non-rigid material and has an opening at the bottom, through which air can be blown into the inflatable body and which can be connected to an opening of the bottom part. For this purpose, the inflatable body has a pulling cord at the bottom, along the edge of the opening, and the bottom part has an outwardly open groove along the periphery of the opening. In order to connect the inflatable body to the bottom part, the edge of the inflatable body with the cord is positioned in the groove and the cord is pulled tight. However, it has to be ensured that the cord is arranged right in the groove before it can be pulled tight. This takes up more time and requires particular care to be taken since, for the correct connection between the inflatable body and bottom part, the cord has to be positioned in the groove over the entire periphery. Furthermore, there is a risk of a user not positioning the cord in the groove over the entire periphery and being unaware of this. Although it is possible, in such a case, to connect the inflatable body to the bottom part, such a connection gives rise to an increased risk of leakage between the bottom part and the inflatable body, this resulting in air escaping and thus in a lower inflating pressure or in increased energy consumption.

SUMMARY OF THE INVENTION

It is accordingly an object of the invention to provide an inflatable body for pressing items of clothing and an apparatus with such an inflatable body, which overcomes the above-mentioned disadvantages of the heretofore-known devices and methods of this general type and which allows the inflatable body to be connected easily, reliably, and securely to the bottom part.

With the foregoing and other objects in view there is provided, in accordance with the invention, an inflatable body for pressing items of clothing, comprising:

an inflatable body formed with an opening and an edge adjoining the opening;

first fastening devices disposed in a vicinity of the edge adjoining the opening, for releasably connecting the inflatable body to second fastening devices on a bottom part; and a shaped part in a vicinity of the first fastening devices.

With the above and other objects in view there is also provided, in accordance with the invention, an apparatus for pressing items of clothing, comprising:

a non-rigid inflatable body formed with an opening defining an edge;

first fastening devices in a vicinity of the edge of the opening;

a rigid shaped part of the inflatable body in a vicinity of the first fastening devices;

a bottom part having second fastening devices for enabling a releasable attachment of the inflatable body to the bottom part; and means for inflating the inflatable body.

By virtue of using a shaped part, there is only a very low risk of the inflatable body being connected inadequately to the bottom part and of this not being noticed by a user. The reason for this is that, for the rigid shaped part, there is only a very small range of intermediate positions, if any at all, in which the shaped part and the first fastening devices can be connected to the fastening devices of the bottom part such that the inflatable body can indeed be fastened on the bottom part, but not in the correct manner. Furthermore, using the shaped part makes it easier and quicker for the user to connect the inflatable body to the bottom part since, by virtue of this rigid shaped part, a relatively large section of the flexible inflatable body can be moved all at once into the position which is necessary for connection.

The first fastening devices may be a plurality of individual fastening means which are distributed over the periphery of the opening of the inflatable body and, in this case, may also be rigid. It is advantageous, however, for the first fastening devices to be flexible or non-rigid, with the result that they can better follow the periphery of the opening of the inflatable body. In the case of flexible or non-rigid first fastening devices, it is also possible for a single fastening means to be used and for this to be guided with not more than one interruption over the periphery of the opening of the inflatable body, with the result that a gap-free connection between the bottom part and inflatable body is achieved. Flexible fastening devices may be constituted, for example, by pulling elements such as a simple cord. A cord may be guided, for example, in a channel in the vicinity of the opening, with the result that the inflatable body can be fastened around a suitable counterpart on the bottom part by virtue of the cord simply being pulled tight.

If use is made anyway of first fastening devices made of an essentially rigid material, they may be configured integrally with the shaped part. In this embodiment, a single part forms both the shaped part and the first fastening devices. For example, in this case, the first fastening devices may be constituted by a bracket which extends around the periphery of the opening of the inflatable body and can interact with second fastening devices of suitable configuration. It is also possible here for the first fastening devices made of a rigid material to comprise a plurality of separate parts which are arranged one behind the other along the periphery of the opening of the inflatable body, in which case the parts can also overlap. In an advantageous development, rigid or solid first fastening devices and the second fastening devices interacting therewith are designed such that the connection between the two fastening devices is produced and/or assisted by a positive pressure prevailing in the inflatable body. For this purpose, the first fastening devices are set up such that an outwardly directed force, as is generated by the inflating pressure within the inflatable body, forces them into a position in which they are connected securely to the second fastening devices. For example, the first fastening devices may have an outwardly directed protrusion which engages beneath an inwardly directed undercut of the second fastening devices and is retained there by the inflating pressure in the inflatable body.

In an advantageous development, the shaped part is of resilient configuration. In such a case, it is possible for the shaped part to be fastened on a suitably configured counterpart on the bottom part. The counterpart on the bottom part is advantageously configured such that the spring force of the shaped part assists and/or secures the connection. For example, it is possible to provide a form-fitting connection between the shaped part and the counterpart, in which case, for connection purposes, the shaped part has to be deformed under the action of force and inserted into the counterpart. The spring force of the shaped part then forces the shaped part into a position in which the form-fitting connection in relation to the counterpart is produced.

If the inflatable body is fastened on the bottom part by a pulling element such as a pulling cord, which is pulled into a groove by being pulled tight, and the edge of the opening is curved inward in one region, the shaped part makes it considerably easier for the pulling element to be fed in since, otherwise, the pulling cord would have to be positioned in an S-shaped curve.

Use is made, particularly advantageously, of a shaped part in the inflatable body of an apparatus for pressing shirts which has a button-strip clamp or an arrangement for fixing a button strip and/or a buttonhole strip of a shirt. Such a button-strip clamp has the advantage that, rather than needing to be buttoned up, a shirt can be retained by the button-strip clamp at the open edges of the button strip. Such a button-strip clamp is usually arranged directly in front of the inflatable body, with the result that it can fix the button strip and/or the buttonhole strip at the location at which the button strip and/or buttonhole strip would be located if the shirt were buttoned up. This means, for the most part, that the button-strip clamp presses partially into the inflatable body, and thus that the periphery of the inflatable body is curved inwards in the region behind the button-strip clamp. The operation of fastening the inflatable body on the bottom part is more complicated in this region as a result of the inward curvature, fastening being rendered more difficult for the user, in addition, as a result of the button-strip clamp arranged in front.

Providing the shaped part on the inflatable body in the region behind the button-strip clamp vastly simplifies connection for the user since, rather than having to reach behind the button-strip clamp, he/she can arrange the inflatable body in this region by means of the shaped part.

The shaped part is advantageously arranged in a mount of the inflatable body together with the first fastening devices. If the first fastening devices do not require any direct contact with the second fastening devices, as is the case, for example, in the case of a pulling cord which is positioned in a groove and pulled tight, it is also possible for the mount to be a closed cavity. This makes it possible, with low outlay, for the shaped part and the first fastening devices to be arranged in the immediate vicinity of one another and connected to the inflatable body. In the case of an inflatable body made of a textile material or sheet-like structure, it is possible for the shaped part and a pulling cord, as first fastening devices, to be sewn in a pocket of the inflatable body, which can be formed along the opening of the inflatable body, for example, by virtue of the hem of the latter being stitched up.

Other features which are considered as characteristic for the invention are set forth in the appended claims.

Although the invention is illustrated and described herein as embodied in an inflatable body for pressing items of clothing, and apparatus for pressing items of clothing which is equipped therewith, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
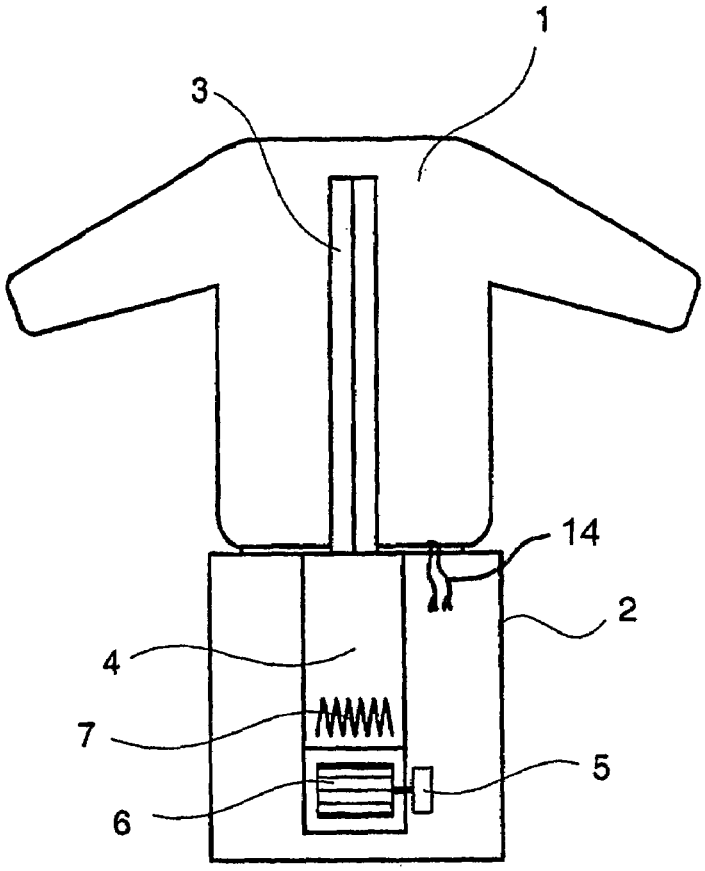
FIG. 1 is a schematic front elevational view of an apparatus according to the invention for pressing items of clothing with an inflatable body.

Referring now to the figures of the drawing in detail and first, particularly, to FIG. 1 thereof, there is shown a shirt pressing apparatus according to the invention which serves for pressing shirts or shirt-like items of clothing. The apparatus has a bottom part 2 with an inflatable body 1 fastened thereon. The inflatable body 1, also referred to as a pressing dummy, is shirt-like and is formed of a non-rigid and selectively air-permeable material.

The bottom part 2 contains a fan 6 which is driven by a motor for blowing air into the inflatable body 1 through an air channel 4. Furthermore, the air channel 4 contains an electric heater 7 for heating the air that is pumped into the pressing dummy, or inflatable body 1. Furthermore, a button-strip clamp 3 is disposed on the bottom part 2. The clamp 3 extends at a small distance in front of the inflatable body 1, longitudinally in relation to the latter. The button-strip clamp 3 is used, in the operation of pressing shirts which are generally open at the front, for fixing the button strip and the buttonhole strip of a shirt which is to be pressed, in order that the shirt remains closed at the front when the inflatable body 1 is inflated.

Figure 2:
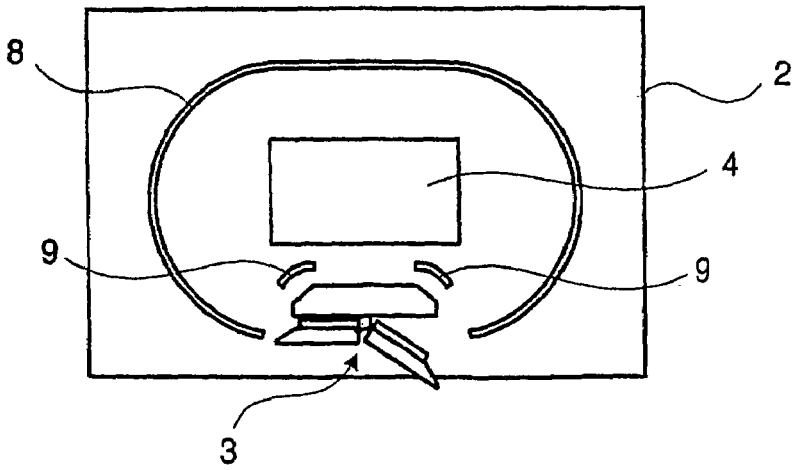
FIG. 2 is a plan view of the bottom part of the apparatus according to FIG. 1 with the inflatable body removed.

FIG. 2 illustrates the bottom part 2 from above with the inflatable body 1 removed. The top side of the illustration has the mouth opening of the air channel 4 substantially in the center. Arranged around the mouth opening of the air channel 4 is a fastening device 8 which, on the front side of the bottom part 2, has an interruption in which the button-strip clamp 3 is arranged. The fastening device 8 is illustrated in a horizontal section in FIG. 6. It is in the form of an angle, or inverted L-bracket, which has its vertical leg fastened on the top side of the bottom part 2 and its horizontal leg directed outward. The fastening device 8 thus forms, together with the top side of the bottom part 2, a groove with an outwardly directed opening. The inflatable body 1 has, at the bottom, an opening of which the edge can be fastened on the bottom part 2 and, for this purpose, has a pulling element (cf. FIG. 7) which, in the exemplary embodiment, is a cord 14. It will be understood that it is also possible, for example, for the pulling element to be a strap, a chain, or a rubber band. For the purpose of fastening the inflatable body 1, the cord can be positioned in the groove formed by the fastening device 8 and pulled tight. The fastening device 8 need not necessarily be in the form of an angle. It is sufficient if the fastening device 8 has an undercut of any desired shape beneath which the cord can be positioned.

With the inflatable body 1 closed in position, it is intended to be arranged in relation to the button-strip clamp 3 advantageously such that the trunk region of a shirt can be tensioned uniformly, and without creasing, in the peripheral direction. For this purpose, the button-strip clamp 3 is arranged such that, with the inflatable body 1 inflated, it presses some way into the inflatable body 1, and surfaces of the button-strip clamp 3 against which the button strip and/or the buttonhole strip are tensioned are located in extension of the surface sections of the inflatable body 1 on both sides of the button-strip claim 3.

Such a configuration of the inflatable body 1 and of the button-strip clamp 3, however, means that, in the region in which the inflatable body 1 is located behind the button-strip clamp 3, the cross section of the inflatable body 1 has an indent, which is also formed at the connecting location between the inflatable body 1 and the bottom part 2. In order for it to be possible for the cord at the bottom of the inflatable body 1 also to be guided around the button-strip clamp 3 along the indentation, two further, rear fastening devices 9 are disposed behind the rear corners of the substantially rectangular cross section of the button-strip clamp 3. The fastening devices 9 are likewise illustrated in section in FIG. 6 and, as shown, they have the same cross section as the fastening devices 8. The horizontal legs of the rear fastening devices 9, however, are directed inward (into the interior of the pressing dummy, pointing towards the rectangular opening 4).

It is disadvantageous, however, that, for the purpose of fitting the inflatable body 1, the cord has to be positioned behind the button-strip clamp 3, in the rear fastening devices 9, from the rear. This is made difficult for a user by the button-strip clamp 3, which is in the way and, in addition, blocks the view. In order to remedy this disadvantage, a shaped part 13 is fitted at the edge of the opening of the inflatable body 1.

Figure 3:
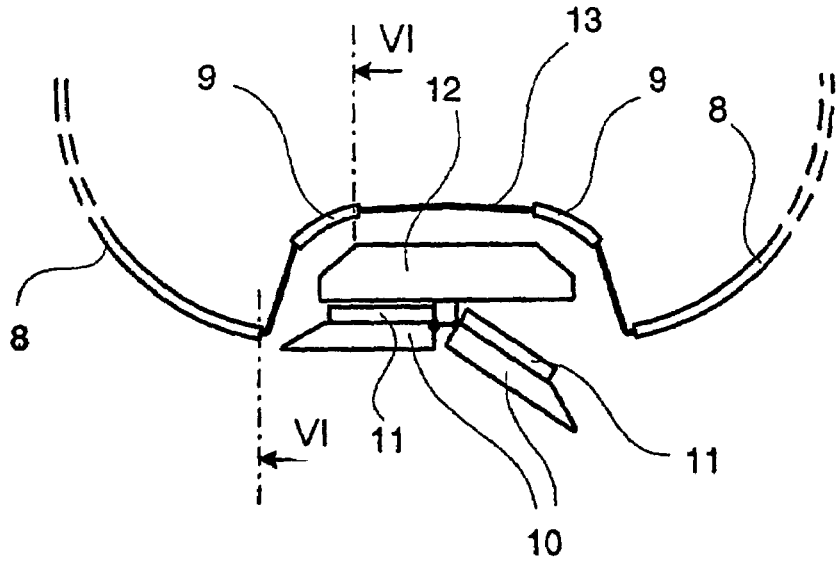
FIG. 3 is an enlarged detail of the top side of the bottom part with the shaped part inserted, without the inflatable body.
Figure 4:
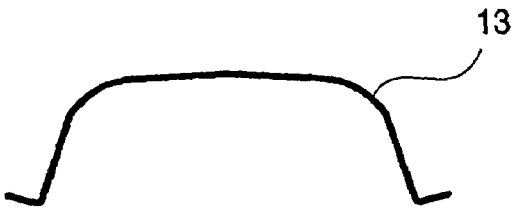
FIG. 4 is a plan view of the shaped part according to FIG. 3.
Figure 5:
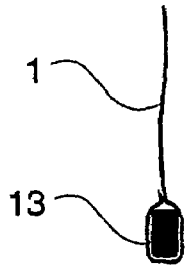
FIG. 5 is a cross section through part of a bottom region of the inflatable body with the shaped part inserted.

FIG. 3 illustrates on an enlarged scale that region of the bottom part 2 around the button-strip clamp 3 in which the front edges of the fastening device 8 and the two rear fastening devices 9 are also located. To give a better view, the shaped part 13 has been illustrated without the inflatable body 1, in a position which it assumes when the inflatable body 1 is fastened on the bottom part 2. The shaped part 13, in addition, is illustrated on its own in FIG. 4.

The button-strip clamp 3, which is illustrated on an enlarged scale in FIG. 3, has a rear part 12, of which the front side forms tensioning surfaces along the edges and on the front of which two tensioning flaps 10 are fastened in a pivotable manner in the center, these flaps, in turn, having a non-slip coating 11 on their side which is directed toward the rear part 12. The tensioning flaps 10 can be prestressed in relation to the rear part 12 by spring force in order for the button strip and/or the buttonhole strip of a shirt which has been placed in position to be forced against the tensioning surfaces for fixing purposes.

The shaped part 13 is resilient and is in the form of a bracket with its ends bent outward at right angles. On account of this shape, the shaped part 13 can be positioned around the two fastening devices 8, 9 such that it is retained securely by them. For this purpose, it is forced forward at the ends by the fastening device 8 and forced rearward, on either side of the center, by the two rear fastening devices 9. The height of the shaped part 13 is low enough to allow it to be positioned in the grooves of the two fastening devices 8, 9, with the result that it is retained in the vertical direction by the horizontal legs of the fastening devices 8, 9.

It is also possible, however, for the shaped part 13 to be connected to the bottom part 2 in other ways. For example, it is possible to form integrally on the shaped part 13 fastening devices which can interact with correspondingly configured fastening devices on the bottom part 2. The shaped part 13 may thus have downwardly projecting hooks or protrusions which can be inserted into openings of the bottom part 2 and locked there.

Figure 6:
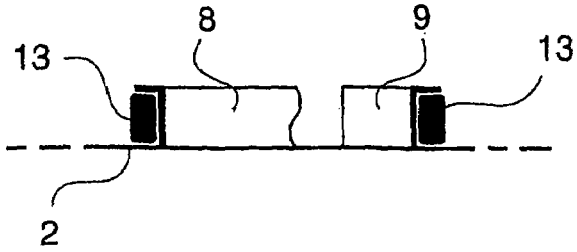
FIG. 6 is a sectional view, taken along the line VI—VI, of the top side of the bottom part shown in FIG. 3.
Figure 7:
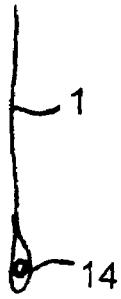
FIG. 7 is a section through part of the hem of the inflatable body with a pull cord inserted.

FIG. 6 illustrates on an enlarged scale, the placement of the shaped part 13 within the grooves of the two fastening devices 8 and 9. The section is taken along the interrupted section line VI—VI in FIG. 3 and viewed in the direction of the arrows.

For the purpose of fastening the inflatable body 1, first of all the shaped part 13 is fastened on the bottom part 2. For this purpose, it is possible for the shaped part 13 to be positioned in the rear fastening device 9, by way of its central section, from the rear, to be bent forward at the ends by virtue of being pulled, and to be positioned in the fastening device 8 from the front by way of the ends. By virtue of the restoring force of the shaped part 13, which forces the ends of the shaped part 13 against the vertical legs of the fastening device 8, the shaped part 13 is retained securely in the two fastening devices 8, 9. Since the shaped part 13 is sewn in the hem of the opening of the inflatable body 1 together with the cord, the insertion of the shaped part 13 also results in the peripheral section of the inflatable body 1 and the cord in the region of the shaped part 13 being positioned in the fastening devices 8, 9 at the same time.

Advantageously, the shaped part 13 can only be connected securely to the bottom part 2 in the correct manner here, with the result that a less than adequate connection which goes unnoticed by the operator is ruled out. The rest of the hem of the inflatable body 1 together with the cord is then positioned beneath the undercut of the fastening device 8 and the cord is pulled tight.

The shaped part 13, on the one hand, facilitates the fastening of the inflatable body 1 on the bottom part 2 and, on the other hand, ensures that the inflatable body 1 is fastened correctly on the bottom part 2. This avoids the situation where the functioning of the apparatus for pressing items of clothing is adversely affected on account of a leaky connection between the bottom part 2 and the inflatable body 1. Furthermore, in one embodiment, it may be provided that the shaped part 13 cannot be displaced along the hem of the opening of the inflatable body 1 and the shaped part 13 can only be inserted at a defined location of the bottom part 2, with the result that the act of placing the shaped part 13 in position predetermines the fastening of the rest of the inflatable-body hem. This avoids the situation where the inflatable body 1 is fastened in a skewed alignment on the bottom part 2.

I claim:

1. A device for pressing items of clothing, comprising:

an inflatable body formed with an opening and an edge adjoining said opening;

first fastening devices disposed in a vicinity of said edge adjoining said opening, for releasably connecting said inflatable body to second fastening devices on a bottom part; and a shaped part including a resilient body connected to the inflatable body in a vicinity of said first fastening devices and engaging the second fastening devices and being bowed radially inwardly beyond the second fastening devices.

2. The device according to claim 1, wherein said first fastening devices are flexible or non-rigid and extend about an entire periphery of said opening, said inflatable body is formed of non-rigid material, and wherein said bottom part includes means for inflating said inflatable body by feeding inflation medium into said inflatable body.

3. The device according to claim 2, wherein the inflation medium is air pumped from said bottom part and through said opening.

4. The device according to claim 2, wherein said first fastening devices comprise a pulling element.

5. The device according to claim 2, wherein said first fastening devices comprise a pull cord at said edge of said opening.

6. The device according to claim 1, wherein said first fastening devices and said shaped part are formed in one piece.

7. The device according to claim 1, wherein said second fastening devices have at least one segment formed with an undercut.

8. The device according to claim 1, wherein said shaped part is a resilient structure.

9. The device according to claim 1, wherein said shaped part extends along part of the periphery of said opening of the inflatable body.

10. The device according to claim 9, wherein said shaped part is an elastically resilient bracket configured to be brought into engagement with a counterpart corresponding to said bracket and belonging to said second fastening devices.

11. The device according to claim 1, wherein said shaped part together with a segment of said first fastening devices are disposed in a receptacle of said inflatable body.

12. The device according to claim 11, wherein said inflatable body is formed of textile material, and said shaped part and at least a portion of said first fastening devices are sewn together in a pocket of said inflatable-body material.

13. The device according to claim 1, wherein said shaped part is formed of plastic and molded onto said inflatable body.

14. An apparatus for pressing items of clothing, comprising:

a non-rigid inflatable body formed with an opening defining an edge;

first fastening devices in a vicinity of said edge of said opening;

a resilient shaped part of said inflatable body in a vicinity of said first fastening devices;

a bottom part having second fastening devices for enabling a releasable attachment of said inflatable body to said bottom part, the second fastening devices including an outer fastening device defining an outer groove facing radially outwardly and a rear fastening device defining a rear groove facing radially inwardly; and means for inflating said inflatable body.

15. The apparatus according to claim 14, wherein said means for inflating said inflatable body include an outlet formed in said bottom part, and, when said inflatable body is connected to said bottom part, said shaped part is disposed between said outlet and a device for fixing shirt-button strips connected to said bottom part and extending substantially along said inflatable body.

16. A shirt-pressing apparatus, comprising:

an inflatable body having a body opening and an edge surrounding the body opening;

a bottom part forming a base supporting the inflatable body and defining an air channel opening for providing air flow to the inflatable body;

a first fastening device mounted to the inflatable body near the edge and including a resilient shaped part; and a second fastening device forming a bracket projecting upwardly from to the bottom part and including an outer fastening device defining an outer groove facing radially outwardly away from the air channel opening and a rear fastening device defining a rear groove facing radially inwardly toward the air channel opening, the first fastening device engaging the second fastening device to reasably connect the inflatable body to the bottom part.

17. The shirt-pressing apparatus according to claim 16, further comprising a rear part forming a member extending vertically upwardly from the bottom part and at least two tension flaps pivotally connected to the rear part, the tension flaps and rear part engaging at least a portion of a shirt on the inflatable body.

18. The shirt-pressing apparatus according to claim 16, further comprising a fan and a heater disposed within the bottom part for providing a heated air flow to the inflatable body.

19. A shirt-pressing apparatus, comprising:

an inflatable body having a body opening and an edge surrounding the body opening;

a bottom part forming a base supporting the inflatable body and defining an air channel opening for providing air flow to the inflatable body;

a first fastening device mounted to the inflatable body near the edge and including a resilient shaped part;

a second fastening device forming a bracket projecting upwardly from to the bottom part and including an outer fastening device defining an outer groove facing radially outwardly away from the air channel opening and a rear fastening device defining a rear groove facing radially inwardly toward the air channel opening, the first fastening device engaging the second fastening device to reasably connect the inflatable body to the bottom part, the shaped part being bowed radially inwardly beyond the second fastening devices and disposed between the rear fastening device and the air channel opening.

20. The shirt-pressing apparatus according to claim 19, wherein the shaped part is at least partially disposed in the outer groove and the rear groove.

* * * * *